United States Patent [19]

Schwarz

[11] 4,034,802

[45] July 12, 1977

[54] RADIATOR MADE OF ALUMINUM FOR CENTRAL-HEATING PLANTS

[76] Inventor: Alois Schwarz, Prantlstrasse near 53, St.Johann in Tirol, Austria

[21] Appl. No.: 545,029

[22] Filed: Jan. 29, 1975

[30] Foreign Application Priority Data

Aug. 7, 1974 Austria ..... 6474/74

[51] Int. Cl.[2] ..... F24H 9/08

[52] U.S. Cl. ..... 165/55; 165/129; 165/171; 165/175; 237/71; 285/40; 285/338

[58] Field of Search ..... 165/129, 130, 175, 55, 165/171, 183; 285/40, 338, 346, 8; 237/71

[56] References Cited

U.S. PATENT DOCUMENTS

| | | | |
|---|---|---|---|
| 156,006 | 10/1874 | Wolfe | 285/40 X |
| 1,885,536 | 11/1932 | Murray | 165/171 X |
| 1,886,292 | 11/1932 | Modine | 165/129 |
| 1,903,125 | 3/1933 | Modine | 165/129 X |
| 1,914,196 | 6/1933 | Davis et al. | 165/129 |
| 2,580,818 | 1/1952 | Mundy et al. | 285/40 |
| 2,793,056 | 5/1957 | Graff | 285/8 |
| 3,074,746 | 1/1963 | Shames et al. | 285/8 |
| 3,366,170 | 1/1968 | Welz | 165/171 X |

FOREIGN PATENT DOCUMENTS

| | | | |
|---|---|---|---|
| 2,133,846 | 12/1972 | France | |
| 633,229 | 10/1927 | France | 165/129 |
| 646,612 | 11/1928 | France | 165/175 |
| 2,326,607 | 5/1972 | Germany | |
| 80,189 | 2/1919 | Switzerland | 165/129 |
| 419,518 | 3/1967 | Switzerland | 165/175 |

*Primary Examiner*—Carlton R. Croyle
*Assistant Examiner*—Edward Look
*Attorney, Agent, or Firm*—Blanchard, Flynn, Thiel, Boutell & Tanis

[57] ABSTRACT

Radiator for transmitting heat from a fluid medium to a surrounding atmosphere. The radiator of the invention contemplates rapid and efficient manufacture of radiator units of different sizes from stock material and is arranged for such manufacture either in a factory or at a construction site. Preferably identical top and bottom channeled parts are provided as top and bottom headers of the radiator and extrudable connecting channels are provided for connecting the top and bottom headers. The connecting channels may be cut in any desired length to provide the radiator units of selected sizes and radiating capacity but without change in the manner of connecting the connecting units into and with respect to the top and bottom headers. A variety of ways are shown for effecting such connecting as well as for providing appropriate fluid connections to and from the radiator units.

6 Claims, 9 Drawing Figures

FIG.6
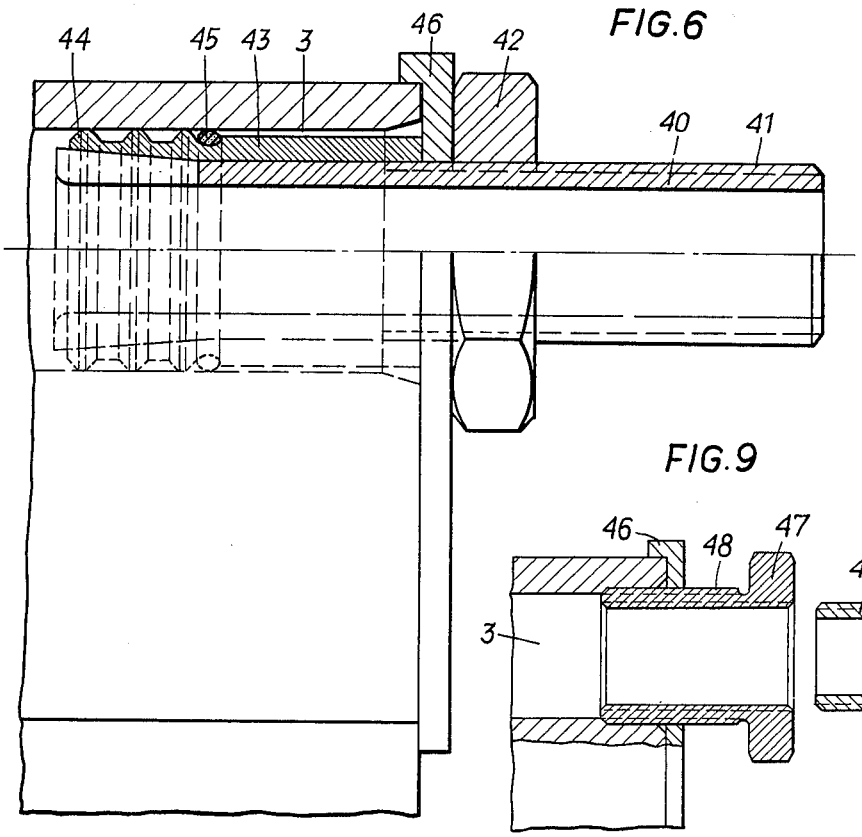
FIG.9
FIG.7
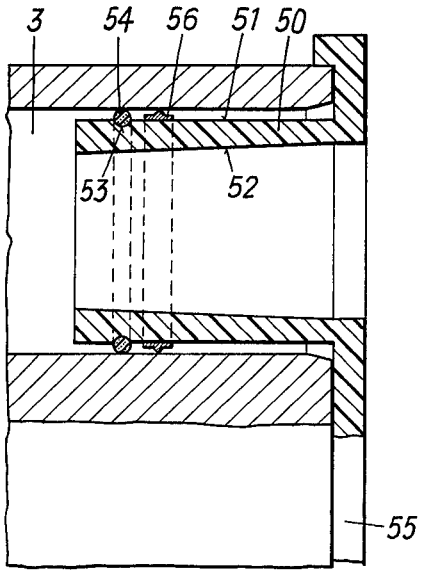
FIG.8
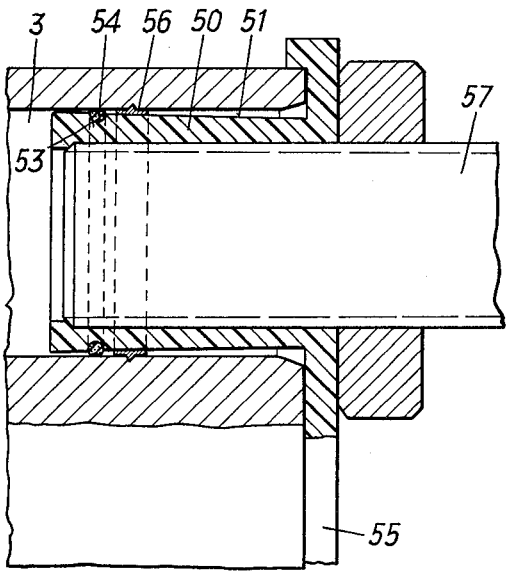

RADIATOR MADE OF ALUMINUM FOR CENTRAL-HEATING PLANTS

FIELD OF THE INVENTION

The invention relates to a radiator made of aluminum for central-heating plants.

BACKGROUND OF THE INVENTION

It is recognized as desirable in some instances to change from the common radiators made of steel plate for central-heating plants to those which are made of aluminum. The reasons for this are that, due to the easier formability of the aluminum, the heat-radiating surfaces can be chosen substantially larger with the same dimensions of the radiators than is the case in steel radiators. Thus, radiators made of aluminum are capable of transmitting substantially more heat while having the same dimensions than those made of steel plate, and aluminum radiators are corrosion-resistant, which does not require the lacquer finish necessary for radiators made of steel plate. Moreover, it is possible to make aluminum radiators of any desired color by the Eloxal process.

However, during the manufacture of aluminum radiators, there exist difficulties since an effective welding of aluminum parts is not possible and the elements or parts thereof must be connected in a sealed relationship by other suitable measures, for example, the elements must be press-connected to one another by steel bolts or rods which are guided in the longitudinal channels through which the heating medium flows.

If the individual elements are manufactured as a unit by pressure casting, it is necessary to connect same near their upper and lower ends. In such a design four connecting points exist for each radiator element. However, this method of manufacture is disadvantageous inasmuch as a separate casting die is needed for each size of radiator. Thus, the manufacture of radiators of different sizes becomes very expensive. A further disadvantage of such radiators is that the elements, in order to be able to be withdrawn from the dies, must be somewhat tapered, which particularly in the case of large radiators leads to an undesirable shape of the elements. The elements are open on one side and must subsequently be closed in a suitable manner. In addition aluminum, in order to accept spraying, must contain iron, which, however, again excludes the Eloxal process.

To avoid the disadvantage of needing a plurality of pressure casting dies, it has further been suggested, to make the central parts of the radiator elements of extruded profiles and to provide same with specially manufactured, extruded head pieces at their upper and lower ends. In this manner radiators having various heights can be produced with equal head pieces by selecting various lengths of the center pieces of the radiators, without necessitating for each size of the elements a separate casting die. Of course, in such case it is not only necessary to connect the elements with one another, but also the head pieces must be connected sealingly with the center parts of the elements. Thus, each element of the radiator has six connecting points, which, in order to achieve the required seal, is technologically very difficult and expensive to manufacture.

Thus the basic purpose of the invention is to produce an aluminum radiator, which avoids the disadvantages existing in the known aluminum radiators which can be made in different sizes, without requiring a plurality of pressure casting dies and in which, further, the individual elements are connected in a technologically simple manner.

SUMMARY OF THE INVENTION

This is achieved according to the invention by a radiator made of aluminum, which is characterized by upper and lower extruded edge strips extending over the length of the radiator and being constructed with channels, between which edge strips the also extruded elements are arranged, wherein the edge strips have holes on the sides facing one another, which holes are spaced from one another at the distance of the elements, and to which holes are fixed sealingly pipe pieces forming the ends of the channels of the elements.

The elements are advantageously formed of a pipe with projecting walls providing the desired radiation of heat, wherein said walls are removed at the ends of the elements leaving pipe pieces which project into the holes provided in the edge strips. Since this removal of wall pieces requires considerable effort, it is alternatively possible to connect the individual elements with the upper and lower edge strips by means of additional pipe pieces, which are inserted on one end into the channels of the elements and on the other side into the holes of the edge strips.

Since it may further be difficult in the manufacture of a radiator of the aforedescribed type to secure the individual elements on the upper and lower edge strips so that they all assume the same vertical position, so that the upper and lower ends of the elements lie exactly in a horizontal plane, at least one of the two edge strips may have on its part facing the elements a stop, preferably a groove, on which rests at least one fin of the radiator elements, for example by extending into the groove.

Furthermore it has been shown to be advantageous, to deflect horizontally forwardly a large portion of the air which flows lengthwise of the radiator, to assure that the air is introduced into the room in which the radiator is located and does not flow up along a wall or a window. This is, aside from heating-technical reasons, also desirable in order to avoid dirt on the wall at which the radiator is located, or, for example, on the drapes which are above the radiator. This purpose is attained according to a further characteristic of the invention by the upper edge strip having a forwardly directed projection, which is used to deflect the air flowing upwardly along the elements. The upper edge strips and the front, upper end of the elements form thus a forwardly directed mouth of the channel, through which the air flows off from the radiator.

Finally the problem to secure the radiator in a simple manner can be solved by providing the elements with an undercut groove on the rearward side, into which groove a fastening device, for example the head of a screw, can be introduced.

In order to mount fittings on the front ends of the radiators and central-heating plants, it is necessary in radiation radiators to weld on connecting pieces. Since a welding is not possible in radiators made of aluminum, the connecting pieces must be secured in some other manner and must be sealed with respect to the radiator. Known measures for securing, for example by means of a tapped thread, and for sealing, for example by means of a seal ring, of these connecting pieces are, however, very complicated and do not meet in many respects the requirements demanded from them. In particular in known devices it is necessary to make special arrangements either during the manufacture of the radiators, namely in the factory, in order not to require any complicated operations during the installation, or, if this is not done, as mentioned, complicated operations are necessary during installation. Even though this is not desirable, since during the installation on building sites the required machines and apparatus are not always available, this procedure may be necessary when the radiators are delivered to building sites in standard lengths and are there cut to the respectively required dimension.

Thus a further purpose of the invention is to produce a device, for which at neither the factory nor during installation are special measures required for securing a short piece of pipe or for mounting a plug.

This is achieved according to a further characteristic of the invention by a pipe piece or plug part which can be inserted into the opening conducting the heating medium, which pipe piece or plug part on the part provided in the hole on its outer surface is enlarged conically toward the end in the hole and is provided on the part outside of the hole with an external thread carrying a nut, and by a radially expandable sleeve, which is arranged between the conically enlarging part and the hole and which is conically tapered on its inner surface toward the front surface of the radiator.

According to a different exemplary embodiment, this is achieved by a pipe piece of hard-elastic material, like hard rubber or hard plastic, which pipe piece can be inserted into the opening conducting the heating medium, whereby the thickness of the wall of the pipe piece increases over its length and into which the connecting piece or a plug can be screwed.

Finally this can also be achieved by screwing a pipe piece of stainless steel, which has a thread on its inner surface and a self-tapping fine thread on its outer surface, into the opening conducting the heating medium.

BRIEF DESCRIPTION OF THE DRAWINGS

The subject matter of the invention will be discussed more in detail in connection with exemplary embodiments which are illustrated in the drawings, in which:

FIG. 6 is an inventive device for mounting a connecting piece on the front end of a radiator, FIGS. 7 and 8 illustrate a device changed with respect to FIG. 6 without a connecting piece and with a connecting piece, and FIG. 9 illustrates a further device for mounting a connecting piece.

DETAILED DESCRIPTION

Figure 1:
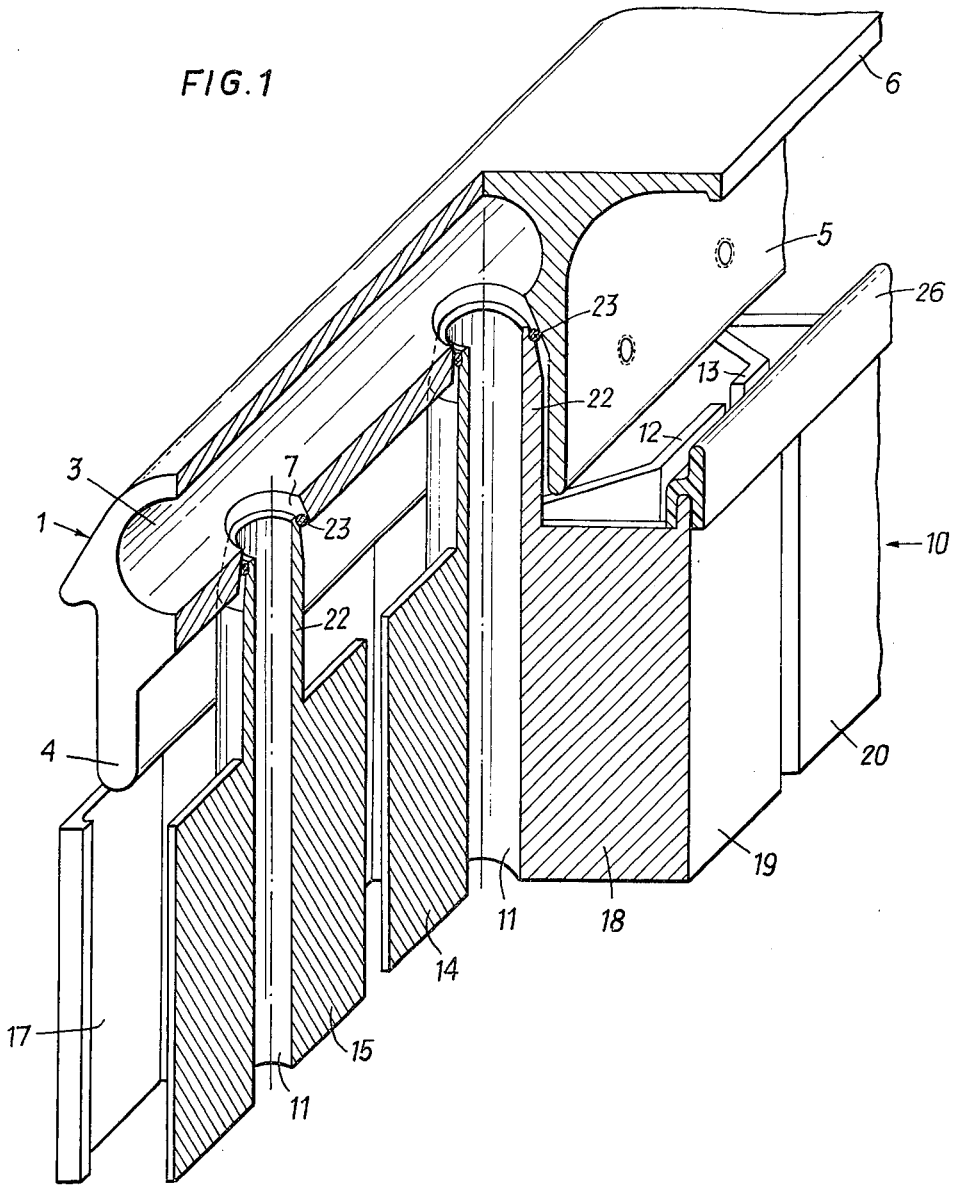
FIG. 1 shows a partially sectional oblique view of one embodiment of the radiator of the invention.

A radiator embodying the invention consists of an upper edge strip 1 and a corresponding, not illustrated, lower edge strip, between which the indivdual elements 10 are arrangedand are connected to the upper and lower edge strips. The edge strips are formed as extruded aluminum profiles, which are constructed with channels 3 for conducting the heating medium. On their sides associated with the elements 10, the edge strips have parallel extending walls 4 and 5. Furthermore, the strip 1 has at its upper end a guiding wall 6 which projects toward the front side of the radiator 2.

The radiator elements 10 are also made of extruded aluminum profiles and consist of a channel 11 for the heating medium, from which channel extend radially a plurality of fins 12 to 18. Said fins 18 have bent portions 19, 20 which extend parallel to the plane of the radiator.

To connect the elements 10 with the upper and lower edge strips, the edge strips have openings 7 between the walls 4 and 5, the space between said openings corresponding to the space between elements 10. The profiles including the elements 10 on their upper and lower ends have the fins 12 to 18 thereof, particularly the bent portions 19, 20, milled off leaving pipe pieces 12 through which the pipe pieces 22 can be inserted between the walls 4 and 5 of the upper and lower edge strip into the openings 7 and can be connected sealingly to the edge strips, for example by using a seal ring 23. For the mechanical connection of the radiator elements 10 to the upper and the lower edge strip, the screws 8 and 9 extending through the walls 4 and 5 are provided, which screws project into recesses provided in the surface of the pipe pieces 22. The pipe pieces 22 can also be secured by means of an adhesive or can be pressed into the openings 7. Finally the upper edge of the bent portions 19 and 20 can be covered by a molding 26.

During the use of such a radiator, the heating medium is fed through the channel 3 of the upper edge strip 1 to the radiator and flows through the channels 11 of the elements 10 to the channel of the lower edge strip. The heating medium emits its heat to the fins 12 to 20 of the elements 10, along which air flows from below upwardly, which air absorbs the heat. Due to the fact that the fins 12 to 20 are milled off at their upper ends, there is a gap between the molding 26 and the horizontally projecting guiding wall 6 of the upper strip 1, through which gap the heated air can flow away from the radiator. Through this special shape of the upper edge strip 1 the air is emitted at the upper front side angularly with respect to the radiator. This is contrary to known radiators, in which the air flows upwardly from the radiator and often effects a dirty accumulation, for example on the wall or on the drapes.

The inlet gap for the cold air which is provided on the underside of the radiator has advantageously a cross section which is approximately 30% larger than the outlet gap for the warm air, which is provided on the upper side of the radiator.

As will be apparent from the above discussion, such a radiator manufactured of extruded aluminum profiles avoids the disadvantages of known aluminum radiators since on the one hand, independent from the height of the radiator, only one single casting die is required for the manufacture of the elements and since furthermore the individual elements are connected also by extruded strips, for which reason tensioning bolts arranged directed in longitudinal direction of the radiator for connecting the elements are not needed. Furthermore, any such bolts as do exist to connect the individual elements with the upper and lower edge strips, and which are arranged outside the channels conducting the heating medium, are not exposed to corrosion caused by the heating medium.

Such a radiator formed of extruded profiles for central-heating plants can be delivered in a few standard lengths, possibly in one single length, to building sites and can there corresponding with the required lengths be separated between two elements, which gives it the required length. The areasof cut formed on the front surfaces can be provided with covers adapted to the color of the radiators or also with covers which are in contrast with the color of the radiators.

Figure 2:
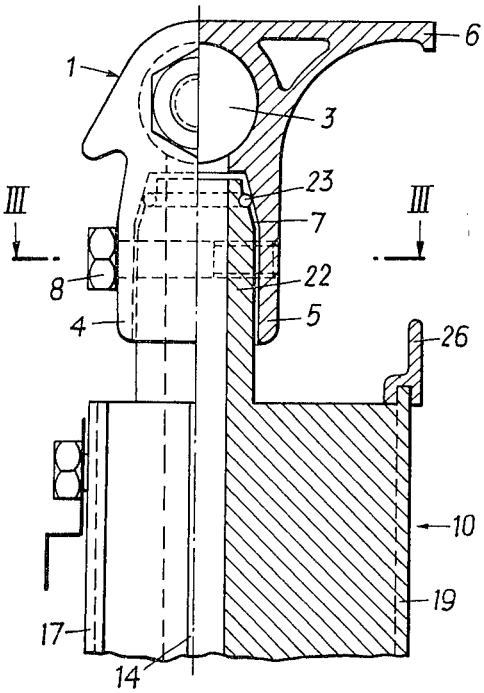
FIG. 2 is a front partially sectional view of this radiator along the line II—II of FIG. 3.
Figure 4:
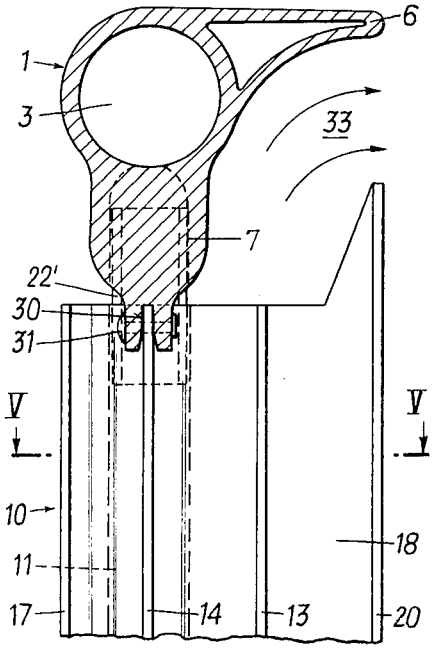
FIG. 4 is a vertical cross-sectional view of the upper part of a modified radiator of aluminum.
Figure 3:
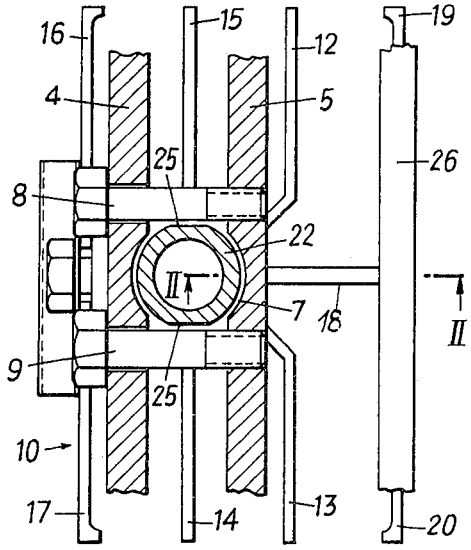
FIG. 3 is a horizontal cross-sectional view of an element of a radiator embodying the invention along the line III—III of FIG. 2.
Figure 5:
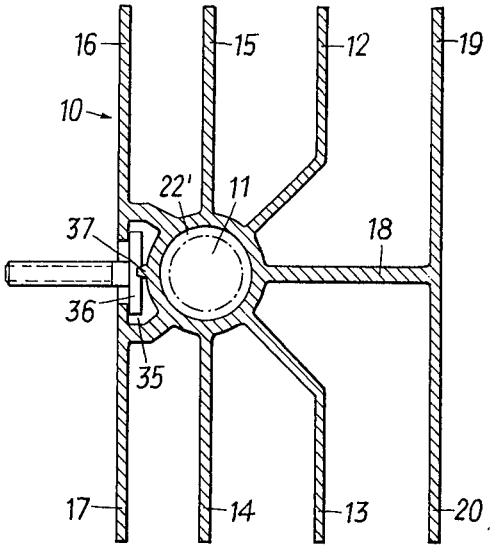
FIG. 5 is a cross-sectional view along the line V—V of FIG. 4.

FIGS. 4 and 5 illustrate an embodiment of a radiator made of aluminum, which is slightly modified as compared to that of FIGS. 1 to 3.

The upper edge strip 1 and the lower edge strip is herein connected to the radiator elements 10 in such a manner that the edge strips have also openings 7 in their part facing the elements 10 and that pipe pieces 22' exist, which on one side are placed into the holes 7 of the edge strips and on the other side into the channels 11 of the elements 10 and are connected to these by means of an aluminum adhesive. The sealing with respect to the heating medium can be further assured by seal rings. To insure that all the elements 10 assume the same vertical position with respect to the edge strips, for example with respect to the upper edge strip 1, the edge strips have a groove 30 at their part facing the elements 10, into which groove extend the fins 14 and 15 of the radiator elements 10 and abut the bottom of thegroove 30. This causes all elements 10 to assume an exactly defined elevational position with respect to the upper edge strip 1.

The edge strips can be further connected to the radiator elements by a rivet or screw 31. In addition it is noted that the pipe pieces 22, 22' may also be secured in the edge strips or radiator elements 10 by means of a press fit.

To assure again that the air which flows up lengthwise of the radiator elements 10 flows horizontally from the radiator, the upper edge strip 1 also has a horizontally projecting nose 6, through which a discharge channel 33 is formed, the mouth of which stands approximately vertically. The air which rises on the rearward side of the fins 16 and 17 and between the fins 15 and 16 or 14 and 17 discharges approximately vertically from the radiator, however, the air rising between the fins 19 and 12 and 12 and 15 or 20 and 13 and 14 lengthwise of the elements 10 is discharged through the channel 33 approximately horizontally from the radiator. This is particularly advantageous in the control of heat distribution.

In order to finally be able to secure such a radiator in a simple manner, an undercut groove 35 is arranged on its rearward side between the fins 16 and 17, into which groove for example the head of a screw 36 can be moved. To effect a securement against rotation of said screw 36, a rib 37 is provided in the groove 35.

A device embodying the invention and arranged for mounting a connecting piece or stop plug will be described more in detail hereinafter in connection with FIG. 6. According to FIG. 6, such a device has at the front end of a radiator a pipe piece 40 which can be inserted into the passageway 3 conducting the heating medium, which pipe piece is constructed on the part which is in the passageway 3 on its exterior surface flaring toward its end and which pipe piece has on the part outside of the passageway an external thread 41, onto which a nut 42 can be screwed.

Between the flaring part of the pipe piece 40 and the passageway 3 of the radiator a sleeve 43 is arranged which at its inner surface converges to fit the pipe piece 40. The sleeve 43 has ribs 44 extending around its outer surface. Also a seal ring 45 is arranged on its outer surface. The sleeve 43 has a plate 46 which is arranged transversely to it and is advantageously constructed integrally with said plate.

The pipe piece 40 is secured on the radiator by first inserting the flaring part into the passageway 3 of the radiator, which passageway conducts the heating medium, thereafter the sleeve 43 is moved into the passageway 3 on the pipe piece 40 until the plate 46 engages the front surface of the radiator, and finally the nut 42 is screwed onto the external thread 41 of the pipe piece 40.

As soon as the nut 42 is screwed on sufficiently that it rests on the outer surface of the cover 46, the pipe piece 40 is pulled outwardly, which causes the outer cone surface of the pipe piece 40 to rest on the inner cone surface of the sleeve 43, whereby same cannot move but can only radially enlarge. This causes the ribs 44 to rest against the walls of the passageway 3 or the seal ring 45 is pressed against the walls of the passageway 3. The ribs 44 achieve a mechanical and the seal ring 45 achieves a sealing connection between the walls defining the passageway 3 of the radiator and the sleeve 43 or the pipe 40.

The sleeve 43 is advantageously manufactured of metal and is slotted. However, it may also be made of elastically deformable material, as for example plastic or hard rubber. If the sleeve 43 and the cover 46 are made of electrically nonconductive material, the pipe 40 which is for example made of copper or steel is electrically insulated by the radiator made of aluminum, by which the formation of corroding currents is avoided.

A valve can for example be screwed onto the external thread 41 of the pipe piece 40. If the pipe piece 40 is closed, this causes a closure for the radiator. An alternative to this is illustrated in FIGS. 7 and 8. According to FIGS. 7 and 8, this device has for securing a connecting piece or a plug at the front end of a radiator a pipe piece 50 which can be inserted into the passageway 3 conducting the heating medium and which is made of a hard-elastic material, like hard plastic or hard rubber. Same is constructed cylindrically on its outer surface 51 and its inner surface 52 tapers conically toward the end lying inside the radiator. In other words, the thickness of the wall of the pipe piece 50 increases toward its end which lies inside the passageway 3. The inner surface 52 of the pipe piece 50 is smooth. Furthermore the pipe piece 50 has on its outer surface 51 at least one groove 53 extending around said outer surface, into which groove a seal ring 54 is inserted. A plate 55 is connected to the pipe piece 50, which plate covers the front surface of the radiator.

The pipe piece 50 is secured on the radiator such that the pipe piece 50 is inserted with its free end into the passageway 3 of the radiator, which passageway conducts the heating medium, whereby the plate 55 rests against the front surface of the radiator, and an externally threaded short piece of pipe 57 or a plug is then screwed into the pipe piece 50, the short piece of pipe being illustrated in FIG. 8.

This causes, due to the conical shape of the inner surface 52 of the pipe piece, the outer surface 51 thereof to be pressed against the wall of the passageway 3 by expanding the pipe piece 50, which provides a mechanical connection between the short piece of pipe 57 and the radiator. The necessary seal is effected by the seal ring 54. Fittings, as for example a valve, can be screwed onto the short piece of pipe 57.

If the mechanical connection of the pipe piece 50 in the passageway 3 of the radiator is not sufficient, a slotted ring 56 made of metal can be slipped over the pipe piece 50, for example between the plate 55 and the O-ring 54, which ring 56 is approximately 5 mm. wide on the side where it rests on the pipe piece 50 and has a sharp edge on the upper side, which edge is anchored by driving a part of the pipe piece 50 into the passageway 3 of the radiator. The pipe piece 50 can have a circumferential groove for holding the mentioned ring 56. This assures that in the case of high pressure the pipe piece 50 cannot be pressed out of the radiator. Alternatively or additionally, it is possible to fasten the pipe piece 50 in the passageway 3 by adhesion.

Finally, FIG. 9 illustrates a pipe piece 47 which is made of a stainless steel and which has an internal thread, into which a pipe 49 can be screwed, and an external fine thread 48. This pipe piece 48 can be screwed into the passageway 3 of the edge strips, wherein the passageway 3 has no thread, but instead a thread is cut by the screwing in of the pipe piece 48.

It will be evident from the foregoing that the described devices permit in a simple manner the securement of a connecting piece at the front end of a radiator for central-heating plants, without requiring that during the manufacture of the radiator special measures be taken in the factory or complicated installation operations be carried out at the building site, and wherein the front end of a radiator can be closed off in a simple manner.

In particular it is possible to transport radiators in uniform lengths to building sites and to cut them there to size corresponding with the requirements, whereby any possibly ragged cut areas are covered by the plate connected to the pipe piece. If a pipe piece manufactured of an insulating material is provided, this is advantageous, since it will interrupt any possible corroding electrical currents.

The embodiments of the invention in which an exclusive property or privilege is claimed are defined as follows:

1. A radiator made of extrudable heat conducting metal, comprising:

a pair of vertically spaced and parallel and elongated collector members each having contours extending parallel to the longitudinal axis thereof and as a result of an extruding thereof, said collector members having a first fluid conducting passageway extending therethrough and parallel to the longitudinal axis thereof, one of said contours being a flange extending generally horizontally from one side of at least the upper one of said collector members;

at least one elongated radiator member having fin-like contours thereon extending parallel to the longitudinal axis thereof and as a result of an extruding thereof, said fin-like contours including means defining a pair of horizontally spaced and parallel walls extending parallel to the longitudinal axis of said collector members, said radiator member having a second fluid conducting passageway extending therethrough and parallel to the longitudinal axis thereof and connected in fluid circuit with said first fluid conducting passageways in each of said collector members, said second fluid conducting passageway being located adjacent one of said walls of said radiator member and forming a hub from which said fin-like contours extend, said flange projecting over the upper ends of a major portion of said fin-like contours which are located between said hub and the other of said walls whereby a heated fluid supplied to said first and second fluid conducting passageways will heat said fin-like contours and air immediately adjacent thereto, said flange deflecting said rising heated air horizontally at the upper end of said radiator member;

at least the upper end of said radiator member has an elongated pipe piece coaxial with the axis of said second fluid conducting passageway and communicating therewith;

at least said upper one of said collector members includes means defining a third fluid conducting passageway communicating with said first fluid conducting passageway and adapted to receive said pipe piece therein; and connecting means for connecting said collector members to said radiator member, said connecting means including means defining a elongated slot in said collector members extending parallel to the longitudinal axis thereof and adapted to straddle the edge one of said fin-like contours.

2. A radiator according to claim 1, wherein the free end of said flange lies in the plane of said other wall.

3. A radiator according to claim 1, wherein said other wall is connected to said hub by a fin-like contour that is perpendicular to the plane of said other wall.

4. A radiator according to claim 1, including seal means for sealing said pipe piece to said third fluid conducting passageway.

5. A radiator according to claim 1, wherein said connecting means includes a pair of spaced and parallel walls between which is received said pipe piece and a screw means for effecting a clamping of said pipe piece between said parallel walls.

6. A radiator made of extrudable heat conducting metal, comprising:

a pair of vertically spaced and parallel and elongated collector members each having contours extending parallel to the longitudinal axis thereof and as a result of an extruding thereof, said collector members having a first fluid conducting passageway extending therethrough and parallel to the longitudinal axis thereof, one of said contours being a flange extending generally horizontally from one side of at least the upper one of said collector members;

at least one elongated radiator member having fin-like contours thereon extending parallel to the longitudinal axis thereof and as a result of an extruding thereof, said fin-like contours including means defining a pair of horizontally spaced and parallel walls extending parallel to the longitudinal axis of said collector members, said radiator member having a second fluid conducting passageway extending therethrough and parallel to the longitudinal axis thereof and connected in fluid circuit with said first fluid conducting passageways in each of said collector members, said second fluid conducting passageway being located adjacent one of said walls of said radiator member and forming a hub from which said fin-like contours extend, said flange projecting over the upper ends of a major portion of said fin-like contours which are located between said hub and the other of said walls whereby a heated fluid supplied to said first and second fluid conducting passageways will heat said fin-like contours and air immediately adjacent thereto, said flange deflecting said rising heated air horizontally at the upper end of the said radiator member;

means defining an undercut groove in said one of said walls into which is received the head end of a screw to facilitate a securement of said radiator to a vertical surface; and a rib in said undercut groove cooperating with said head end of said screw to prevent rotation of said screw.

* * * * *